US010829948B1

(12) United States Patent
Bader

(10) Patent No.: US 10,829,948 B1
(45) Date of Patent: Nov. 10, 2020

(54) SUPPORT BRACKET FOR RAILING SYSTEM

(71) Applicant: Michael A. Bader, Sioux Falls, SD (US)

(72) Inventor: Michael A. Bader, Sioux Falls, SD (US)

( * ) Notice: Subject to any disclaimer, the term of this patent is extended or adjusted under 35 U.S.C. 154(b) by 355 days.

(21) Appl. No.: 15/832,945

(22) Filed: Dec. 6, 2017

(51) Int. Cl.
*E04G 21/32* (2006.01)

(52) U.S. Cl.
CPC ..... *E04G 21/3233* (2013.01)

(58) Field of Classification Search
CPC ..... E01F 13/02; E01F 13/022; E01F 9/0122; E01F 9/0124; E04H 17/14; E04H 17/18; E04H 17/22; E04H 12/22; E04H 12/2238; E04H 12/2253; E04G 21/3233; E04G 21/3238
See application file for complete search history.

(56) References Cited

U.S. PATENT DOCUMENTS 3,809,346 A * 5/1974 Jackson ..... E04H 12/223 248/530
5,560,588 A * 10/1996 Hilliard ..... E04H 12/2269 256/65.06
5,568,909 A * 10/1996 Timko ..... E04H 12/2261 248/519
6,015,139 A * 1/2000 Weber ..... E04F 11/1812 256/65.14
6,336,620 B1 * 1/2002 Belli ..... E04F 11/1814 248/519
6,585,080 B2 7/2003 Murray
6,640,517 B2 * 11/2003 Mitchell ..... E04C 3/34 52/298
6,679,482 B2 1/2004 Allenbaugh
6,694,700 B1 * 2/2004 Mackett ..... E04B 1/0046 403/205
7,044,448 B1 * 5/2006 Jones ..... E04F 11/181 256/19
8,689,938 B2 * 4/2014 Kenton ..... E04G 21/3233 182/113
8,875,469 B1 * 11/2014 Keller, Sr. ..... E02D 5/60 248/346.01

(Continued)

FOREIGN PATENT DOCUMENTS

CN 104989118 10/2015
EP 2880230 5/2016
JP 062403 1/1994

*Primary Examiner* — Daniel J Wiley
(74) *Attorney, Agent, or Firm* — Jeffrey A. Proehl; Woods, Fuller, Shultz & Smith, PC

(57) ABSTRACT

A support bracket may include a base portion having an upper surface and a lower surface for resting on a surface, and a mount portion securely mounted on the base portion. The mount portion may include a perimeter wall having a lower end mounted on the base portion such that the mount portion extends away from the upper surface, and an upper end with an upper opening. The bracket may form a socket for receiving a lower end portion of an upright post. The socket may have a cross section size with a width and a depth, and a length substantially equal to the maximum extent to which the lower end portion of the upright post is insertable into the socket. The length of the socket may be greater than approximately two times the width of the socket.

17 Claims, 3 Drawing Sheets

(56) References Cited

U.S. PATENT DOCUMENTS

| | | | | |
|---|---|---|---|---|
| 9,004,439 | B2 * | 4/2015 | Gross | E04H 12/2269 248/507 |
| 9,165,488 | B1 * | 10/2015 | Johnson | G09F 15/0075 |
| 9,564,071 | B1 * | 2/2017 | Johnson | G09F 15/0075 |
| 2004/0245516 | A1 * | 12/2004 | Fuoco | E04F 11/1812 256/65.14 |
| 2006/0010672 | A1 | 1/2006 | Kuenzel | |
| 2012/0032129 | A1 | 2/2012 | Metzidakis | |
| 2013/0256491 | A1 | 10/2013 | House | |
| 2016/0123035 | A1 | 5/2016 | Simmons | |

* cited by examiner

SUPPORT BRACKET FOR RAILING SYSTEM

BACKGROUND

Field

The present disclosure relates to railings and more particularly pertains to a new support bracket for railing system for facilitating the installation and removal of the railing system.

SUMMARY in one aspect, the present disclosure relates to a support bracket for supporting an upright post of a railing assembly in an upright orientation on a surface. The support bracket may include a base portion having an upper surface and a lower surface for resting on the surface, with the base portion having at least one hole through which a fastener is able to pass to through the base portion to secure the base portion to the surface on which the lower surface of the base portion rests. The bracket may also include a mount portion securely mounted on the base portion, and the mount portion may include a perimeter wall having a lower end mounted on the base portion such that the mount portion extends away from the upper surface, and an upper end with an upper opening. The bracket may form a socket for receiving a lower end portion of the upright post. The socket may have a cross section size with a width and a depth, and the socket may have a length substantially equal to the maximum extent to which the lower end portion of the upright post is insertable into the socket. The length of the socket may be greater than approximately two times the width of the socket.

In another aspect, the disclosure relates to a temporary safety railing system for use on a floor surface which may comprise a railing assembly including a plurality of upright posts each having a substantially vertical orientation and a lower end portion, and at least one rail extending between at least two of the upright posts. The system may also include a support bracket supporting at least one of the upright posts of a railing assembly in an upright orientation on the floor surface. The support bracket may include a base portion having an upper surface and a lower surface for resting on the surface, and may have at least one hole through which a fastener is able to pass to through the base portion to secure the base portion to the surface on which the lower surface of the base portion rests. The bracket may also include a mount portion securely mounted on the base portion and having a perimeter wall having a lower end mounted on the base portion such that the mount portion extends away from the upper surface. The perimeter wall may have an upper end with an upper opening. The bracket may form a socket for receiving the lower end portion of the upright post. The socket may have a cross section size with a width and a depth, and the socket may have a length substantially equal to the maximum extent to which the lower end portion of the upright post is insertable into the socket. The length of the socket may be greater than approximately two times the width of the socket.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
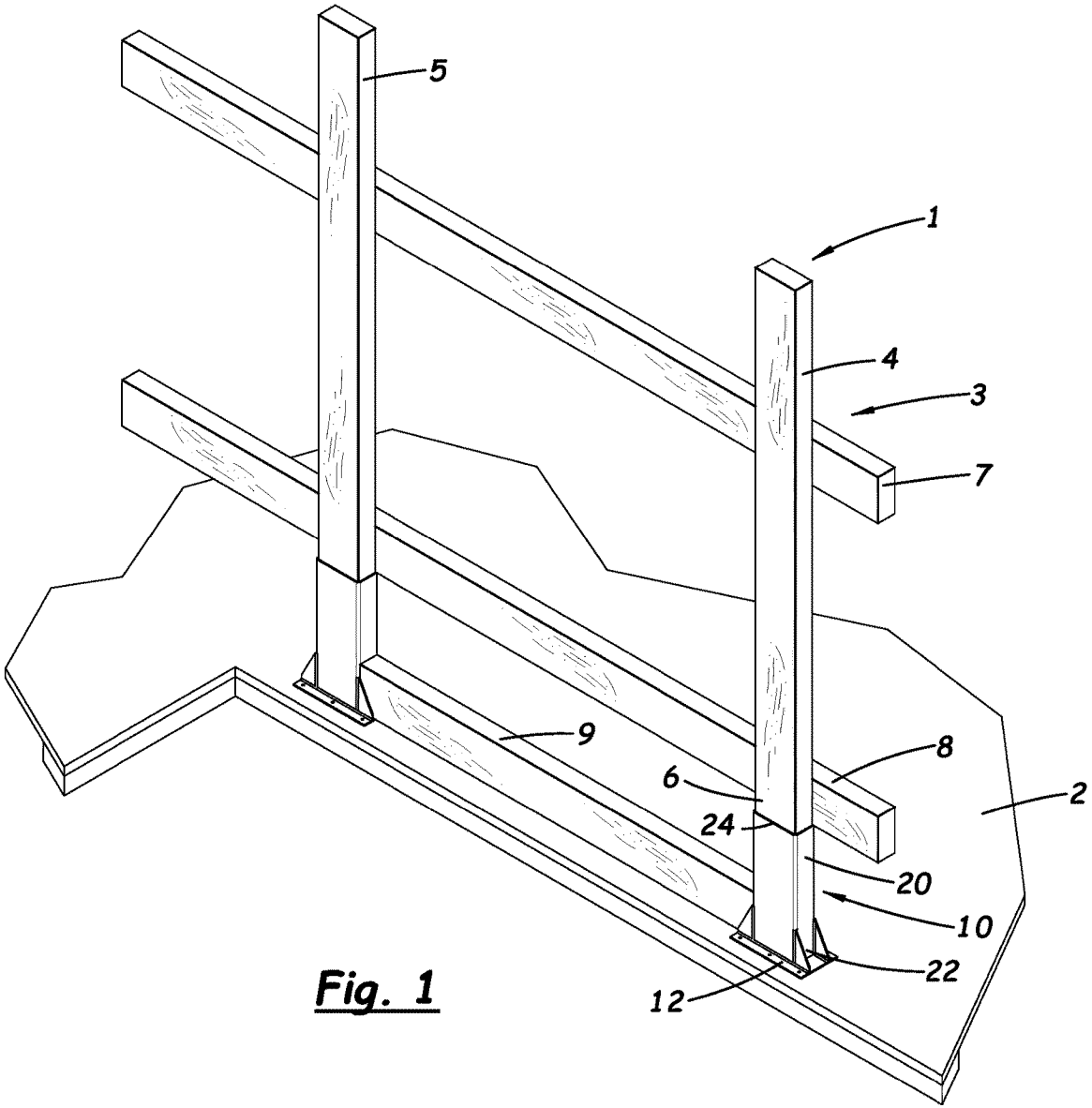
FIG. 1 is a schematic perspective view of a temporary railing system including a new support bracket according to the present disclosure.
Figure 2:
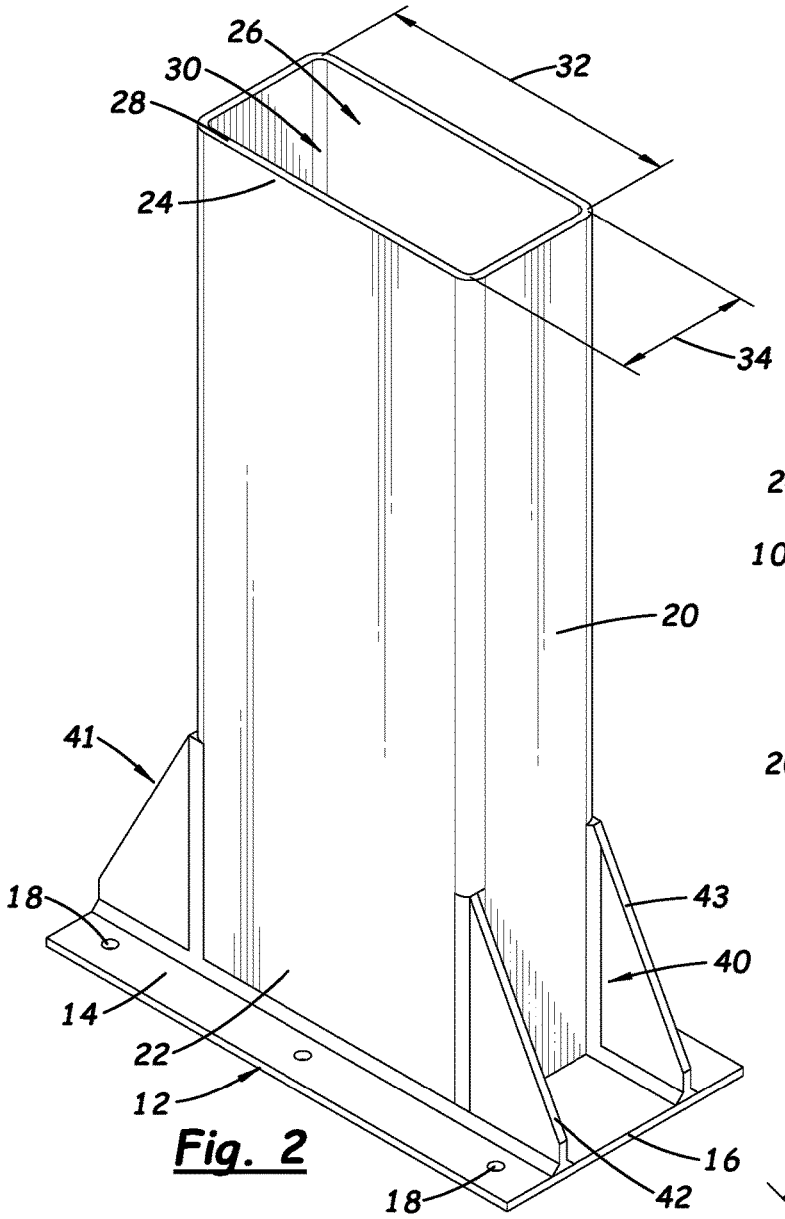
FIG. 2 is a schematic perspective view of an illustrative embodiment of the support bracket.
Figure 3:
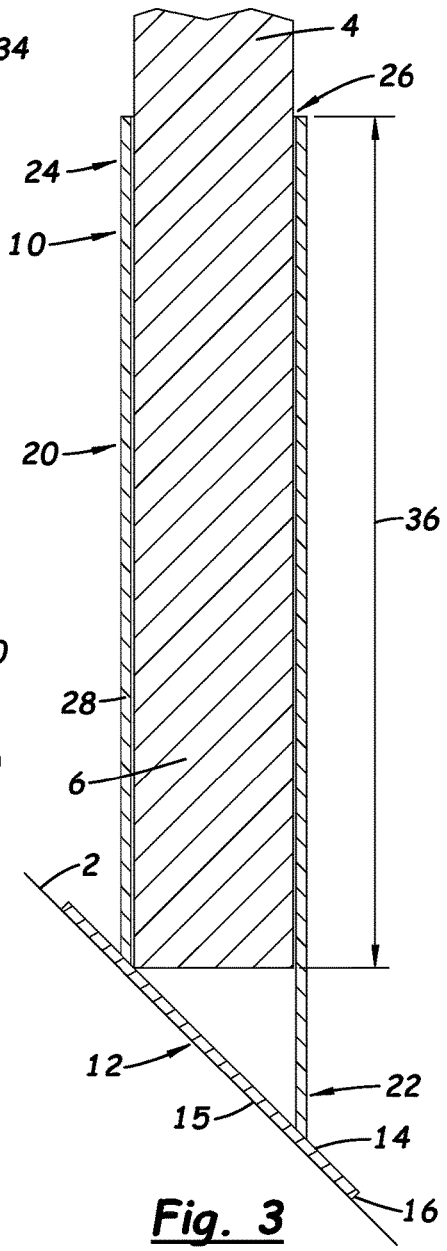
FIG. 3 is a schematic side sectional view of another illustrative embodiment of the support bracket.

With reference now to the drawings, and in particular to FIGS. 1 through 4 thereof, a new support bracket for railing system embodying the principles and concepts of the disclosed subject matter will be described.

Temporary railings are often used as barriers to enhance safety in construction areas where hazards such as openings in floors or drop-offs are present. The temporary railings are often formed from construction grade lumber usually available at the construction jobsite and fastened together using nails or screws. The upright posts are often nailed on the side of a joist forming the opening, and alternatively devices have been developed to help mount the posts to a floor surface but still require the use of multiple fasteners to hold the parts of the railing together, and in particular in the known post mounting devices. It is not unusual that the temporary railings need to be removed and reinstalled to facilitate the movement of materials into and out of the jobsite, which requires removal and reinstallation of fasteners used with the known devices. The applicant has recognized it would be advantageous to eliminate the use of at least some of the fasteners from the railings to simplify the assembly and disassembly of the railing assembly on the jobsite, and in particular to simplify the process when the railing needs to be removed for a short time and then reinstalled. The applicant has devised a support bracket for the posts that avoids the use of some fasteners to help facilitate the assembly, disassembly, and short term removal of the railing assembly.

In one aspect, the disclosure relates to a temporary safety railing system 1 for use on a floor surface 2 adjacent to a hazard from which persons need to be separated, such as an opening in the floor surface or the side of a ramp or a stairway. The railing system 1 may include a railing assembly 3 which may include a plurality of upright posts 4, 5 which may be spaced from each other and have a substantially vertical orientation in the railing assembly. Each of the upright posts 4, 5 may have a lower end portion 6 located opposite of the upper end. The railing assembly 3 may also include at least one rail 7 which extends between at least two adjacent but spaced upright posts. The rail 7 may extend in a substantially horizontal orientation between the two posts, but in some implementations the rail may have a sloped orientation angled with respect to the horizontal. In some embodiments, a pair of rails 7, 8 may be employed with a first or upper rail 7 being positioned toward the top of the upright posts 4, 5, and a second or lower rail 8 being positioned between the upper rail 7 and the floor surface 2.

In another aspect, the disclosure relates to a support bracket 10 either alone or in combination with elements of the railing assembly 3 as a part of the system 1. The support bracket may be configured to support one of the upright posts of the railing assembly in a substantially vertical orientation. The support bracket 10 may be configured to be mounted on a substantially horizontal surface and support the post in the upright orientation, or may be configured to be mounted on a sloped surface and support the post in the upright orientation. In some implementations, the sloped surface may have an orientation of approximately 45 degree angle with respect to the horizontal.

In greater detail, each of the support brackets 10 may include a base portion 12 and a mount portion 20. The base portion 12 may have an upper surface 14 and a lower surface 15 for resting on or abutting against the floor surface 2 when the support bracket is mounted for use. The base portion 12 may have an outer perimeter 16, and in some embodiments the outer perimeter may have a substantially rectangular shape and may be elongated in a direction oriented substantially parallel to the direction of the railing system 1. The base portion 12 may comprise a base plate having a substantially uniform thickness with substantially planar upper 14 and lower 15 surfaces. The base portion 12 may have one or more holes 18 through which a fastener is able to pass through in order to secure the base portion to the floor surface 2 or other support on which the railing assembly is to be mounted.

The mount portion 20 may be securely mounted on the base portion 12. The mount portion may extend away from the upper surface of the base portion, and may extend in a substantially perpendicular relationship to the lower surface 15 of the base portion, or may extend in an angled orientation to the lower surface, such as at a substantially 45 degree angle with respect to the lower surface 15. The base plate of the base portion 12 may form a flange extending outwardly from the mount portion 20. The mount portion 20 may have a lower end 22 which is mounted on the base portion and an upper end 24 opposite of the lower end. The mount portion 20 may be tubular, and the upper end 24 of the mount portion may have an upper opening 26 through which the lower end portion 6 of an upright post may be inserted. The mount portion may include a perimeter wall 28 which may have a substantially rectangular cross-sectional shape.

The support bracket 10 may form a socket 30 for receiving the lower end portion of one of the upright posts, with the mount portion forming the sides of the socket and the base portion forming a closed end of the socket. The socket 30 may have a substantially rectangular cross sectional shape with a size defined by a width 32 and a depth 34. The width 32 of the socket may be greater than the depth or the socket such that the shape of the cross section is somewhat elongated. In some embodiments, the width may be approximately twice the depth. Illustratively, the width may be approximately 4 inches and the depth may be approximately 2 inches. Optionally, the width may be approximately 6 inches and the depth may be approximately 2 inches, or the width and depth may both be approximately 4 inches. The width and the depth may be sized is substantially snugly receive the lower end portion of a nominal 2 inch by 4 inch piece of lumber commonly used in construction, which may actually measure approximately 1¾ inches by approximately 3½ inches.

The socket 30 of the support bracket 10 may also have a length 36 measured from the upper opening 26 into the socket. The length of the socket, or the maximum extent to which the lower end portion of the upright post may be inserted into the socket, may be defined between the upper 24 and lower 22 ends of the mount portion although there may be some variation. In some embodiments, the length of the socket may be greater than approximately 2 times the width of the cross section of the socket. In some embodiments, the length of the socket may be approximately 2 times to approximately 4 times the width of the cross section of the socket. Illustratively, the length of the socket may be approximately 12 inches. Qualitatively, the length of the socket may be sufficiently long to accept a portion of the upright post long enough so that a fastener does not need to be used to secure the post in the socket formed by the mount portion, or such that the post is not likely to fall out of the socket without being purposefully pulled out to remove the post from the socket.

Optionally, the support bracket 10 may have a pocket 40 which may be formed on the base portion and may also be formed on the mount portion of the bracket, to accept an additional rail 9 located below the second rail 8 and may be positioned adjacent to the floor (see FIG. 1). In some embodiments, the support bracket 10 may include a pair of the pockets 40, 41, and the pockets may be oriented such that they open in substantially opposite directions with respect to each other. Each pocket may include or be formed by a pair of tabs 42, 43 which may be spaced from each other to form the interior of the pocket between the tabs. The tabs may be mounted on the base portion, and may extend upwardly from the upper surface 14 of the base portion. The tabs may also be mounted on the mount portion, such as on an exterior surface of the perimeter wall 28.

Figure 4:
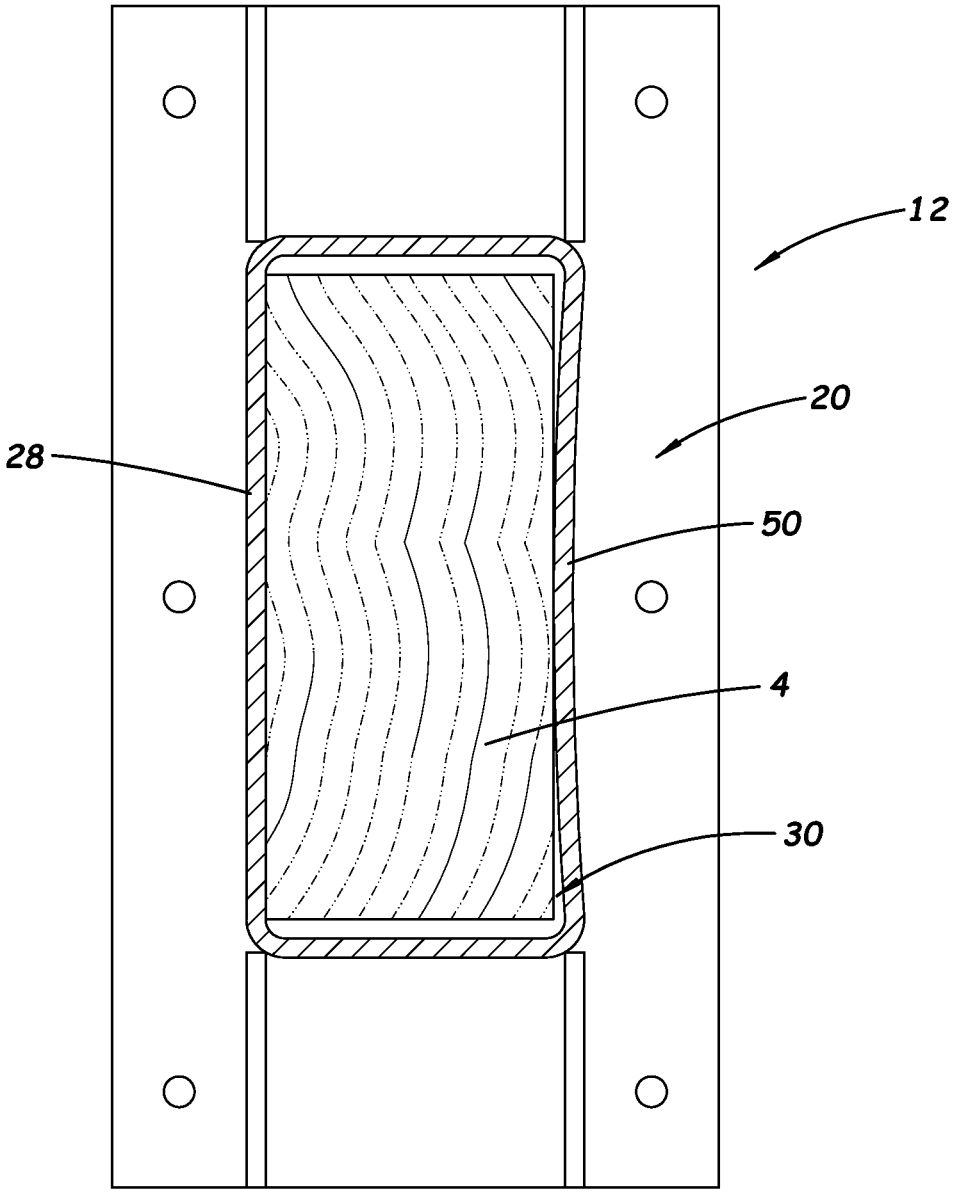
FIG. 4 is a schematic top sectional view of still another illustrative embodiment of the support bracket.

As a further option, and as is illustratively shown in FIG. 4 of the drawings, a crease or bend may be formed in one section 50 of the perimeter wall 28 of the mount portion 20. The crease in the section may extend generally in the longitudinal direction of the mount portion to effectively decrease the width of a portion of the socket 30 to help locate and secure an upright post 4 in the socket. The creased section 50 may effectively create a lodgment of the post in the socket 30 that may cause a slight outward deflection of the creased section when the post is inserted, and may help minimize any looseness of the post in the socket. The creased section 50 may also provide a degree of resistance to movement of the post out of the socket without requiring the use of fasteners to provide the resistance to withdrawal of the post from the socket.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that steps set forth in the description and/or shown in the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A support bracket for supporting an upright post of a railing assembly in an upright orientation on a surface, the support bracket including:

a base portion having an upper surface and a lower surface for resting on the surface, the base portion having at least one hole through which a fastener is able to pass through the base portion to secure the base portion to the surface on which the lower surface of the base portion rests;

a mount portion securely mounted on the base portion, the mount portion including a perimeter wall having a lower end mounted on the base portion such that the mount portion extends away from the upper surface, the perimeter wall having an upper end with an upper opening;

wherein the bracket forms a socket for receiving a lower end portion of the upright post, the socket having a cross section size with a width and a depth, wherein the socket has a length substantially equal to the maximum extent to which the lower end portion of the upright post is insertable into the socket, the length of the socket being greater than approximately two times the width of the socket;

wherein the support bracket includes a pair of pockets opening in substantially opposite directions with respect to each other, each of the pockets being at least partially formed by the mount portion, each of the pockets being formed by a pair of pocket walls oriented substantially parallel to each other, a distance between the pair of pocket walls of a said pocket being equal to the depth of the cross section size of the socket;

wherein the perimeter wall includes an inwardly creased portion extending between the lower and upper ends thereof, thereby decreasing the width of the socket.

2. The bracket of claim 1 wherein the length of the socket is approximately two times to approximately four times the width of the socket.

3. The bracket of claim 1 wherein the length of the socket is approximately three times the width of the socket.

4. The bracket of claim 1 wherein the length of the socket being at least approximately 12 inches.

5. The bracket of claim 1 wherein the width of the cross section size of the socket is greater than the depth.

6. The bracket of claim 5 wherein the width of the cross section size of the socket is twice the depth of the cross section size of the socket.

7. The bracket of claim 1 wherein the width of the cross section size of the socket is approximately 4 inches and the depth of the cross section size of the socket is approximately 2 inches.

8. The bracket of claim 1 wherein the width and the depth of the cross section size of the socket are sized to snugly receive the lower end portion of an upright post formed of a single nominal 2"×4" piece of lumber.

9. The bracket of claim 1 wherein the perimeter wall of the mount portion has side wall sections defining their between the depth of the cross section size of the socket, the perimeter wall of the mount portion having end wall sections defining therebetween the width of the cross section size of the socket, the width of the cross section size being greater than the depth of the cross section size; and wherein each pocket is formed adjacent to one of the end wall sections, each of the pockets being formed by the respective end wall section and the pair of pocket walls extending from the mount portion, each of the pocket walls forming a planar extension of one of the side wall sections of the perimeter wall.

10. The bracket of claim 1 wherein each pocket wall forming a said pocket of the pair of pockets has an outer edge which extends from the mount portion to the base portion substantially linearly such that each pocket wall has a substantially triangular face.

11. The bracket of claim 1 wherein the mount portion extends in a substantially perpendicular relationship to the lower surface of the base portion.

12. The bracket of claim 1 wherein the perimeter wall of the mount portion includes sections positioned on opposite sides of the socket, a first one of the sections being creased inwardly toward a second one of the sections from an orientation to produce a gradual convergence of inner faces of the first and second sections of the perimeter wall toward the crease and create a reduction in the width of the socket between inner faces of the sections along the crease to press the inner faces against a post inserted into the socket.

13. A temporary safety railing system for use on a floor surface, the system comprising:

a railing assembly including:

a plurality of upright posts, the posts having a substantially vertical orientation, each of the posts having a lower end portion; and at least one upper rail extending between at least two of the upright posts; and a lower rail extending between the lower end portions of the at least two upright posts;

a support bracket supporting at least one of the upright posts of a railing assembly in an upright orientation on the floor surface, the support bracket including:

a base portion having an upper surface and a lower surface for resting on the surface, the base portion having at least one hole through which a fastener is able to pass through the base portion to secure the base portion to the surface on which the lower surface of the base portion rests;

a mount portion securely mounted on the base portion, the mount portion including a perimeter wall having a lower end mounted on the base portion such that the mount portion extends away from the upper surface, the perimeter wall having an upper end with an upper opening;

wherein the bracket forms a socket receiving the lower end portion of the upright post, the socket having a cross section size with a width and a depth, the width of the cross section size of the socket being twice the depth of the cross section size of the socket; and wherein the support bracket includes a pair of pockets opening in substantially opposite directions with respect to each other, at least one of the pockets receiving an end of the lower rail of the railing assembly, each of the pockets being at least partially formed by the mount portion, each of the pockets being formed by a pair of pocket walls oriented substantially parallel to each other, a distance between the pair of pocket walls of a said pocket being equal to the depth of the cross section size of the socket;

wherein the perimeter wall includes an inwardly creased portion extending between the lower and upper ends thereof, thereby decreasing the width of the socket.

14. The system of claim 13 wherein the length of the socket is approximately two times to approximately four times the width of the socket.

15. The system of claim 13 wherein the length of the socket is approximately three times the width of the socket.

16. The system of claim 13 wherein the width and the depth of the cross section size of the socket are sized to snugly receive the lower end portion of an upright post formed of a nominal 2"×4" piece of lumber.

17. The system of claim 13 wherein each pocket wall forming a said pocket of the pair of the pockets has an outer edge which extends from the mount portion to the base portion substantially linearly such that each pocket wall has a substantially triangular face.

* * * * *